United States Patent [19]

Bersonnet et al.

[11] Patent Number: 4,844,451

[45] Date of Patent: Jul. 4, 1989

[54] EXERCISE CYCLE WITH LOCKING MECHANISM

[75] Inventors: George B. Bersonnet, Riverheights; Dante L. Schumway, Cove, both of Utah

[73] Assignee: Weslo, Inc., Logan, Utah

[21] Appl. No.: 226,135

[22] Filed: Jul. 29, 1988

[51] Int. Cl.[4] ..... A63B 21/00; A61H 1/02

[52] U.S. Cl. ..... 272/73; 128/25 R

[58] Field of Search ..... 272/73, 130, 144, 72; 128/25 R

[56] References Cited

U.S. PATENT DOCUMENTS

| | | | |
|---|---|---|---|
| 3,075,766 | 1/1963 | Buscher | 272/73 |
| 4,463,945 | 8/1984 | Spector | 272/73 |
| 4,602,781 | 7/1986 | La Marsh et al. | 272/73 |
| 4,729,559 | 3/1988 | McNeil | 272/130 |
| 4,753,435 | 6/1988 | Carnielli | 272/73 |
| 4,757,988 | 7/1988 | Szymski | 272/73 |

*Primary Examiner*—S. R. Crow

*Attorney, Agent, or Firm*—Trask, Britt & Rossa

[57] ABSTRACT

The invention provides an exercise cycle with a stationary frame, a seat, a pedal mechanism, and a rotating wheel. Resistance is offered to the rotating wheel by an adjustable brake assembly. A handle bar assembly is pivotally mounted to the frame to move back and forth toward and away from the user positioned on the seat. A locking mechanism is associated with the handle bar assembly, so that with the locking mechanism in a first position, the handle bar assembly is precluded from pivoting. With the locking mechanism in a second position, the handle bar assembly is allowed to pivot toward and away from the user. A resistance mechanism is also associated with the handle bar assembly.

7 Claims, 4 Drawing Sheets

EXERCISE CYCLE WITH LOCKING MECHANISM

BACKGROUND OF THE INVENTION

Field: The invention is directed to an exercise cycle, and more particularly to an exercise cycle with a movable handle bar assembly which may be selectively locked in a stationary position.

State of the Art: Stationary exercise cycles have been popular for years. Typically, an exercise cycle has a stationary frame with a seat, a pedal assembly, and a handle bar assembly. The user sits on the seat and places his feet on the pedal assembly and his hands on the handle bar assembly. The user pedals his feet to drive a wheel or other drive mechanism to simulate riding a bicycle. Typically, the wheel or other drive mechanism includes an adjustable resistance mechanism so that the user can vary the amount of resistance applied to the wheel or drive mechanism, thus varying the amount of exercise provided to the user's legs, and also varying the aerobic conditioning provided.

In some cycles, the handle bar assembly is driven in a back and forth motion synchronously with the motion of the pedal assembly. The present cycles do not allow a user to choose between a stationary handle bar arrangement or a movable handle bar arrangement in which the handle bar assembly is free to pivot forward and backward, independent of the motion of the pedal assembly. A stationary handle bar assembly may allow the user to concentrate more on exercise of the legs and lower portion of the body, while a movable handle bar assembly may provide a more general body workout, including exercise of the abdomen, back, and arms, and also increasing the amount of aerobic exercise provided. Thus, there remains a need for an exercise cycle convertible between a movable handle bar assembly and a stationary handle bar assembly.

SUMMARY OF THE INVENTION

An exercise cycle includes a frame means for positioning on a support surface. A seat means is adapted to the frame means to support the user. A drive means is adapted to the frame means for operation by the feet of a user positioned upon the seat means. A first resistance means is adapted to the frame means and is drivingly interconnected with the drive means to resist movement of the drive means. A handle bar means is adapted to the frame means for grasping by the user positioned on the seat means and for movement toward and away from the user while positioned upon the seat means. A second resistance means is interconnected to and between the handle bar means and the frame means to resist movement of the handle bar means. A locking means is adapted to the frame means for selectively preventing movement of the handle bar means. The locking means is operable by the user between a first position, in which the handle bar means is movable toward and away from the user, and a second position, in which the handle bar means is locked in a preselected position in which it is not movable.

In another embodiment, the locking means may include a shaft which is rotatably mounted to the frame means and a bar which is adapted to the handle bar means. A catch means may be adapted to the shaft, the catch means operable between a first position, in which the bar is engaged and the handle bar means is locked and not movable, and a second position, in which the bar is movable relative to the catch means. A lever means may be provided and positioned for movement by the user, the lever means adapted to the shaft for movement between the first and second positions.

In another embodiment, the frame means may include a leg structure which is shaped and formed for positioning on the support surface and to support the exercise cycle with the user thereon. The leg structure may have a forward leg portion and a rear leg portion. A seat means may be affixed to the leg structure proximate to the rear leg portion to extend upwardly therefrom. A housing member may be affixed to the leg structure forward of the seat member. The housing member may have a face portion which is reachable by the arms of a user positioned on the seat means. The lever means may extend through the face portion.

In another embodiment, the first resistance means may include a wheel with a brake adjustably associated therewith and operable by a user to vary the resistance. The second resistance means may be a fluid cylinder.

In another embodiment, the handle bar means may include a tubular structure having an upper end and a lower end. A handle means may be secured to the upper end for grasping by the user. A pivot means may be secured to the tubular structure at a preselected distance from the lower end of the tubular structure for pivotally mounting the handle bar means to the housing member. The bar may be adapted to the tubular structure proximate the lower end. The fluid cylinder may be connected to the tubular structure proximate the lower end.

In another embodiment, the drive means may include a pedal assembly positioned for movement by the feet of the user. A chain and sprocket drive assembly may be connected to the pedal assembly and the wheel for rotation of the wheel upon operation of the pedal assembly.

The tubular structure may be a pair of spaced apart tubes. The pivot means may be secured between the spaced apart tubes. The bar may also be secured between the spaced apart tubes.

The catch means may include a pawl with a distal and a proximate end. An indentation may be formed in the pawl proximate its distal end to register with the bar, the pawl being rotatable about the shaft at its proximate end. The lever means may be secured to the pawl at its proximate end to rotate the pawl about the shaft.

DETAILED DESCRIPTION OF THE PREFERRED EMBODIMENT

Figure 1:
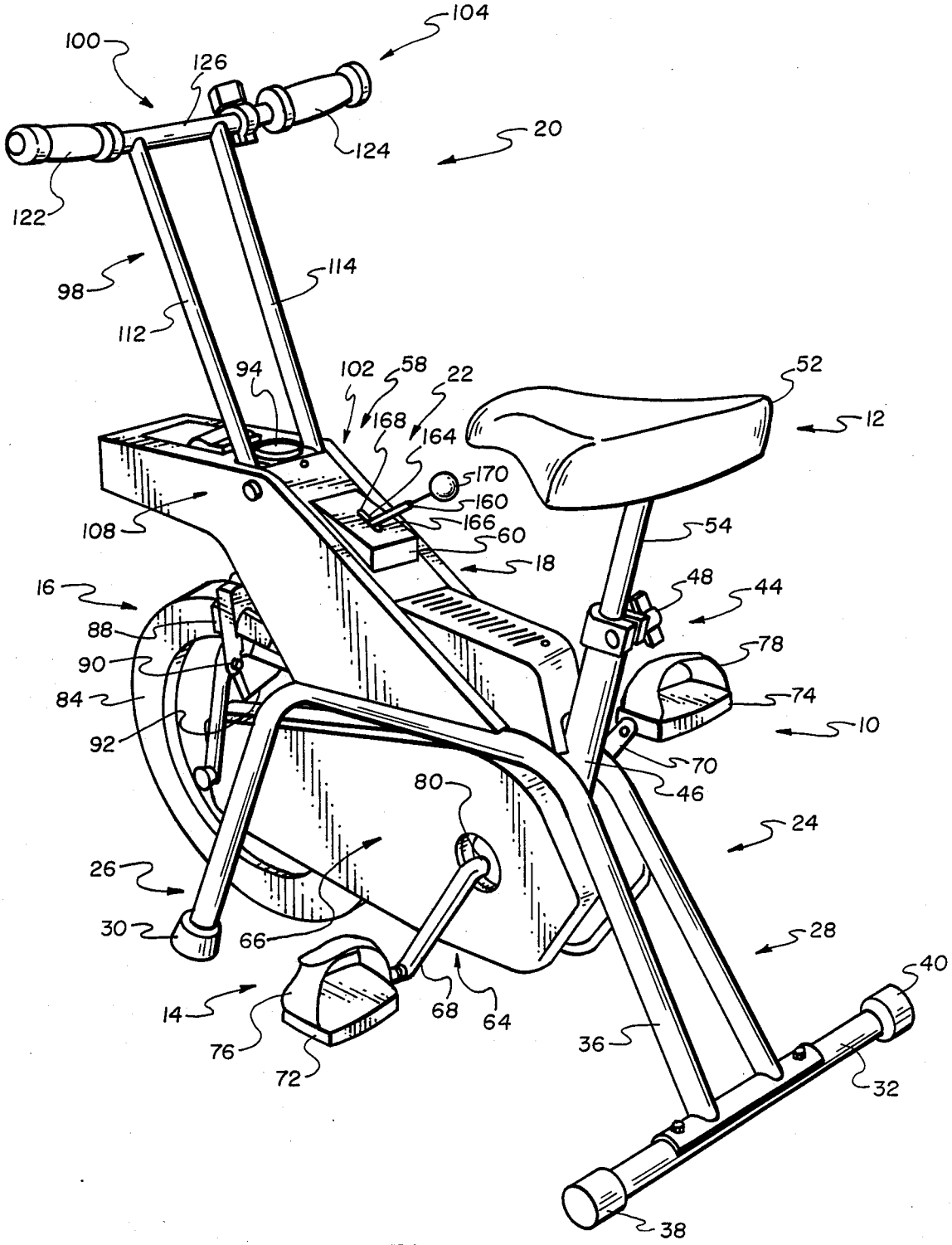
FIG. 1 is a perspective view of an exercise cycle of the invention.

As shown in FIG. 1, an exercise cycle of the invention includes a frame means 10, a seat means 12, a drive means 14, a first resistance means 16, a second resistance means 18 (not shown in FIG. 1, but illustrated in FIGS. 2 and 3), a handle bar means 20, and a locking means 22. Briefly, a user seated upon the seat means 12 drives the drive means 14 with his feet and grasps the handle bar means 20 with his hands, while facing towards the handle bar means 20. With the locking means 22 in a first position, described more completely hereafter, the handle bar means 20 is movable toward and away from the user. With the locking means 22 in a second position, the handle bar means is locked in a fixed or preselected position and is not movable. The use of the exercise cycle of FIG. 1 is described more completely hereafter.

The frame means 10 includes a leg structure 24 which includes a forward leg portion 26 and a rear leg portion 28. The leg structure 24 is preferably formed of tubular steel, but may be formed of any appropriately rigid material, such as an alloy of aluminum, magnesium, or other light but sturdy metal. As shown, forward leg portion 26 includes a cap 30, which is preferably formed of a soft, rubber-like material such as a synthetic rubber or plastic. Also as shown, rear leg portion 28 includes a cross member 32 mounted to tubes 34 and 36. Mounted to the end of tube 32 are a pair of caps 38 and 40, similar to cap 30. Forward leg portion 26 is formed of extensions of tubes 34 and 36 bent in the curved shape shown in FIG. 1. Other members of frame means 10 are secured to leg structure 24 by any convenient securing method such as, for example, by welding.

Also as shown in FIG. 1, frame means 10 includes a seat member 44, which is shown to include a tubular member 46 which is secured to the leg structure 24 near rear leg portion 28. Tube member 46 is preferably welded to tubes 34 and 36 and extends, as shown, upwardly therefrom. Seat member 44 is adapted for holding and securing seat means 12, upon which the user positions himself. As shown, tube member 46 includes a typical wing nut locking mechanism 48 attached to tube member 46 and which is commonly known in the art.

Seat means 12 includes a seat 52, which is attached to a shaft 54. Shaft 54 is slidingly received by tube member 46. Wing nut locking mechanism 48 may be tightened around shaft 54 to lock shaft 54 into a stationary position relative to tube 46. Thus, seat means 12 may be raised or lowered to accommodate users of varying height by loosening wing nut locking mechanism 48, raising or lowering the shaft 54 within tube 46, and then locking wing nut locking mechanism 48 again upon shaft 54.

Figure 2:
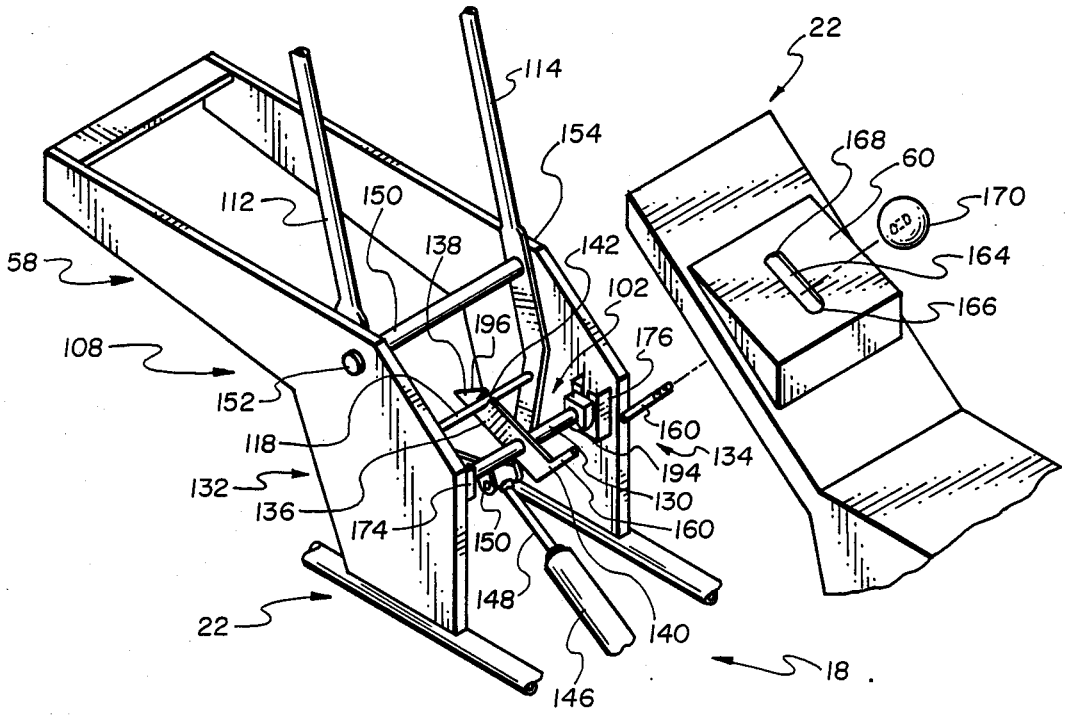
FIG. 2 is a perspective cut-away view of details of a housing member and locking means of the invention.

Frame means 10 also includes a housing member 58, which is more completely shown in FIG. 2. Housing member 58 is mounted to the leg structure 24, preferably, for example, by welding. The housing member is mounted forward of seat member 44. Housing member 58 includes a face portion 60 which is reachable by the arms of a user positioned upon the seat means 12. The housing member 58 houses important portions of the locking means 22, and also serves as a pivotal mounting for handle bar means 20.

Drive means 14 is mounted to frame means 10 for operation by the feet of a user positioned on seat means 12. Drive means 14 includes a pedal assembly 64 and a chain and sprocket drive assembly 66 (not shown). Pedal assembly 64 is a typical pedal mechanism including shafts 68 and 70 to which are pivotally mounted pedals 72 and 74, respectively. Attached to pedals 72 and 74 are straps 76 and 78, respectively, which serve to secure a user's feet upon pedals 72 and 74. Straps 76 and 78 are preferably adjustable to fit varying sizes of users' feet, and may include, for example, hook and loop strips or other adjustment systems for varying the size of straps 76 and 78. Shafts 68 and 70 rotate about an axle 80 in a manner well known in the art.

Pedal assembly 64 is linked to chain and sprocket drive assembly 66, which is typically a sprocket mounted to one of the shafts, such as shaft 68 which is in turn engaged to a chain, which then engages another sprocket mounted to wheel 84. Rotational pedalling motion of pedal assembly 64 drives, through chain and sprocket assembly 66, wheel 84 to turn. Wheel 84 is preferably a high inertia wheel. Wheel 84 is preferably formed of cast iron, but maybe formed of other appropriate heavy materials such as steel, to provide inertial resistance to movement.

First resistance means 16 includes wheel 84 and brake 88. Brake 88 is constructed in a manner which is well known in the art to variably resist the rotation of wheel 84. Brake 88 is operated by a lever assembly 90 which is connected via a cable 92 in a manner well known in the art to an adjustment knob 94. By rotating knob 94 clockwise or counterclockwise, the user may adjust the amount of resistance offered to the rotation of wheel 84, thus varying the amount of conditioning and aerobic exercise provided to the user by operation of pedal means 4.

Handle bar means 20 includes a tubular structure 98 formed of an upper end 100 and a lower end 102. Tubular structure 98 is, similar to leg structure 24, preferably formed of tubular steel, but may be formed of any rigid, lightweight material, such as an alloy of magnesium or aluminum. Handle means 104 is mounted to the upper end 100 of the tubular structure as shown. A pivot means 108 is secured to the tubular structure 98 at a preselected distance from the lower end 102. The pivot means 108 pivotally mounts the handle bar means 20 to the housing member 58, as more clearly depicted in FIGS. 2 and 3. Handle bar means 20 is thus allowed to pivot to positions such as those depicted in dotted lines in FIG. 3, i.e., to move through angles A and B.

As shown in FIG. 1, tubular structure 98 includes a pair of spaced apart tubes 112 and 114. Also as shown, pivot means 108, more completely described hereafter, is secured between spaced apart tubes 112 and 114. As shown in FIG. 2, a bar 118 is adapted to the tubular structure proximate the lower end 102 of the tubular structure. Bar 118 is adapted to lower end 102 of tubular structure 98 by, for example, being welded thereto.

Referring again to FIG. 1, the handle means 104, in the illustrated embodiment, includes a pair of handle grips 122 and 124 which are attached to upper end 100 of tubular structure 98. Upper end 100 of tubular structure 98 is shown in the illustrated embodiment to be a tube 126 which is mounted to spaced apart tubes 112 and 114, for example, by being welded thereto.

A description of the interrelationship between the handle bar means, second resistance means, and locking means is made more particularly in references to FIGS. 2 through 6. Referring now to FIG. 2, locking means 22 includes a shaft 130, bar 118, a catch means 132, and a lever means 134. Catch means 132 includes a pawl 136 having a distal end 138 and a proximate end 140. An indentation 142, which is shown to be a U-shaped notch, is formed in distal end 138 of pawl 136, as shown (see also FIGS. 3 and 4).

Figure 3:
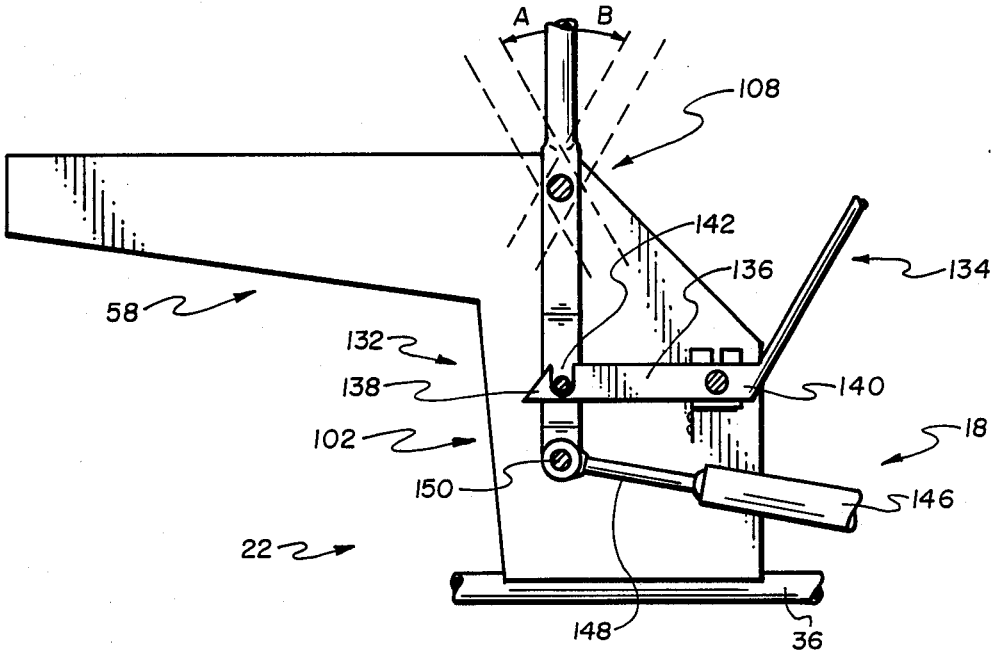
FIG. 3 is a plan cut-away view of details of a housing member and locking means of the invention.

Second resistance means 18 is shown to be a fluid cylinder 146 with a shaft 148 pivotally attached by an axle and bracket assembly 150 to lower end 102 of tubular structure 98. The other or base end of fluid cylinder 146 is pivotally attached to frame means 10 in a manner not shown but proximate to tubular seat member 46. The base end (not shown) of fluid cylinder 146 is pivotally attached to frame means 10 by an axle and bracket assembly similar to axle and bracket assembly 150. Spaced apart tubes 112 and 114 of handle bar means 20 are pivotally associated with housing 58 by means of pivot means 108. As shown in FIGS. 2 and 3, pivot means 108 is shown to include an axle 150 connected between tubes 112 and 114 and pivotally mounted within holes 152 and 154 formed in housing 58. Thus, the handle bar means 20 is allowed to pivot about axle 150.

With locking mechanism 22 in its first position, i.e., with indentation 142 in engagement with bar 118, as shown in FIGS. 2 and 3, handle bar assembly 20 is precluded from rotating about axle 150 and is thus precluded from moving toward and away from a user positioned on seat means 12.

When shaft 130 and pawl 136 of locking mechanism 22 is rotated counterclockwise from the position shown in FIGS. 2 and 3, indentation 142 moves out of engagement with bar 118 to place locking mechanism 22 in a second position in which handle bar means 20 is allowed to pivot about axle 150 to move toward or away from a user positioned on seat means 12. Lever means 134 may be operated by a user positioned on seat means 12 to move the locking mechanism 22 from the described first and second positions.

Lever means 134 is shown in the illustrated embodiment to be a rod 160 attached to pawl 136 at its proximate end 140, as shown. A rounded knob 170, preferably formed of a rigid material such as plastic, is threadingly mounted on rod 160, as shown in FIG. 1, to provide a convenient handle for operating rod 160 to move rod 160 and to thus operate locking mechanism 22 between its first and second position, as described.

Face member 60 attaches to housing member 58 by any convenient means, such as with screws. As shown in FIGS. 1 and 2, when face member 60 is attached to housing member 58, rod 160 passes through an elongate hole 164 formed in face member 60. When rod 160 is positioned proximate the bottom end 166 of hole 164, locking mechanism 22 is in the first position, in which handle bar means 22 is locked from movement toward and away from the user. When rod 160 is moved to be proximate the top end 168 of hole 164, locking mechanism 22 is in its second position, in which handle bar means 20 is allowed to pivot about axle 150 toward and away from a user. When the locking mechanism 20 is in its second position, as described, second resistance means 18, via fluid cylinder 146, offers resistance to the forward and back motion of handle bar means 20. The resistance offered by fluid cylinder 146 increases the amount of conditioning and aerobic exercise provided to a user.

Figure 4:
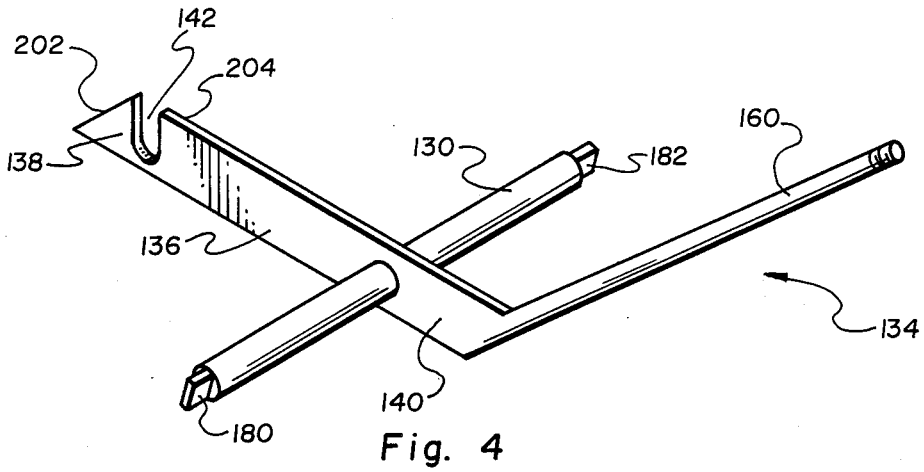
FIG. 4 is a perspective view of a lever means and pawl assembly of the invention.
Figure 5:
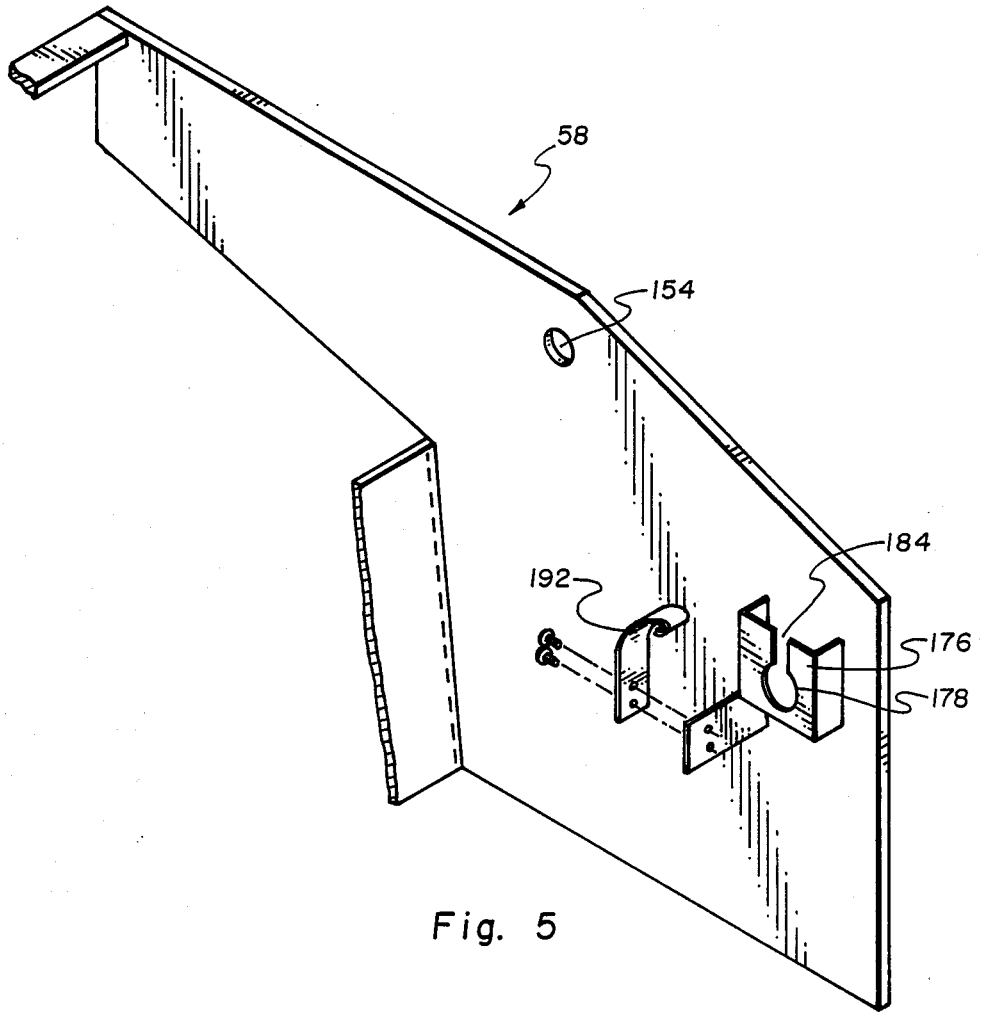
FIG. 5 is a perspective cut-away view of a housing member and bracket assembly of the invention.
Figure 6:
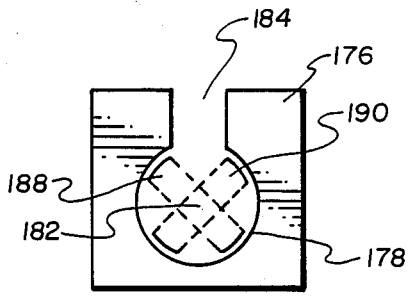
FIG. 6 is a plan view of alternative positions of notched member 182 within bracket 176.

The mounting of locking mechanism 22 to housing member 58 is described more particularly in reference to FIGS. 4, 5 and 6. Referring first to FIG. 2, shaft 130 is pivotally associated with housing member 58 at brackets 174 and 176. As shown in FIG. 6, brackets 174 and 176 include a generally circular section 178. The ends of shaft 130 include tongues 180 and 182. In assembly, tongues 180 and 182 are slid through openings such as opening 184 in bracket 176 (see FIG. 6) and then turned to one of the positions shown by the dotted lines in FIG. 6. In position 188, the locking mechanism 22 is in its first position. When shaft 130, and thus tongue 182 (and likewise tongue 180), is rotated to position 190, locking mechanism 22 is in its second position, in which the handle bar means 20 is allowed to pivot about axle 150.

Figure 7:
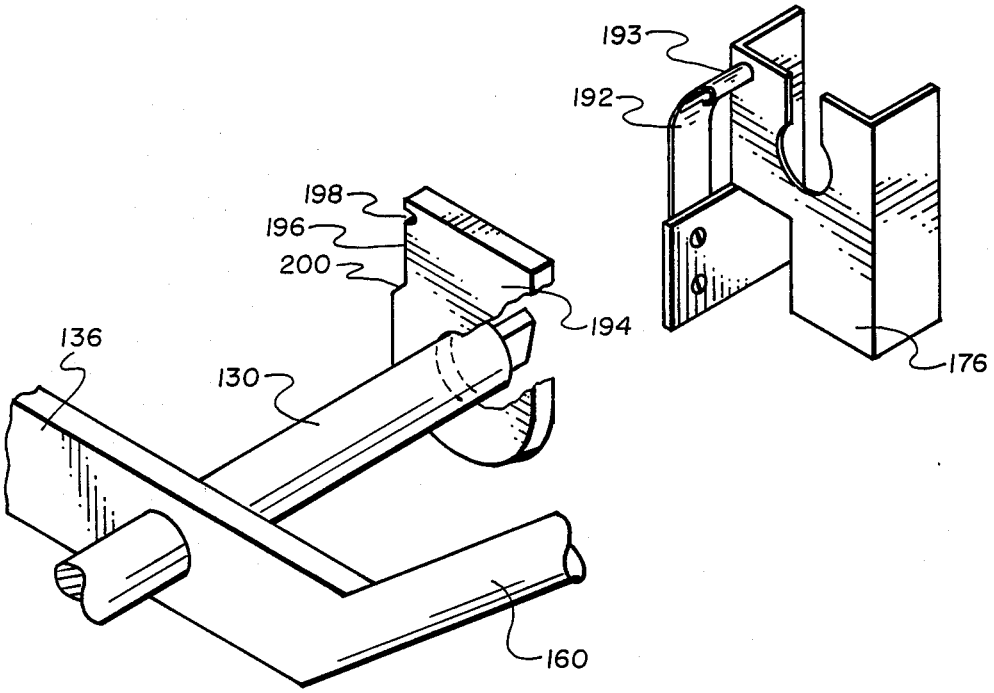
FIG. 7 is an exploded cut-away perspective view of details of a spring member and cam assembly of the invention.

Brackets 174 and 176 are mounted to housing member 58 by any convenient method, such as, for example, by spot welding. Attached to bracket 176 is a spring member 192 (see FIGS. 5 and 7). Spring member 192 is attached to bracket 176 by, for example, screws. Referring to FIG. 7, spring member 192 registers with cam 194 attached to shaft 130. Tip 193 of spring member 192 registers with surface 196 of cam 194. Tip 193 of spring member 192 registers with indentation 198 formed in surface 196 of cam 194 when the locking mechanism 22 is in its unlocked position. When the locking mechanism 22 is in its locked position, spring member 192 registers with surface 196 at shoulder 200 of cam 194. The registration between spring 192 and surface 196 at indentation 198 or shoulder 200 provides sufficient resistent against rotation of shaft 130 to preclude shaft 130, and therefore pawl 136, from rotating relative to brackets 174 and 176, without the user moving knob 170, and therefore rod 160.

Spring member 192 is preferably formed of a resilient and elastic material, such as, for example, spring steel. The registration between spring member 192 and indentation 198 or shoulder 200 of surface 196 provides for discrete and selectible positions of shaft 130 relative to bracket 176, i.e., in the positions 188 and 190 illustrated in FIG. 6. Thus, the user may sense, such as by a click or vibration or slight movement of knob 170, when the locking mechanism 22 has been brought into registration into its first or second positions, as described.

In use, a user positions himself, i.e., seats himself, upon seat 52 placing his feet upon pedals 72 and 74 and within the straps 76 and 78. The user may then adjust straps 76 and 78 to securely hold his feet upon pedals 72 and 74. The user faces handle bar means 20 and grasps grips 122 and 124 with his left and right hands, respectively. If the user desires to adjust the amount of resistance offered to the rotation of pedals 72 and 74, he adjusts knob 94 to vary the resistance at brake 88 applied to wheel 84.

If the user desires to lock handle bar means 20 in the position generally shown in FIG. 1, so that handle bar means 20 is precluded from moving toward or away from the user, he moves rod 160 by means of knob 170 toward the bottom 166 of hole 164, generally as shown in FIG. 1. If the user moves knob 170 to the position shown before the handle means 20 is moved into its fixed position as shown in FIG. 1, the handle bar means may subsequently be moved until bar 118 comes into engagement with indentation 142. If the handle bar means 20 is initially positioned clockwise of its orientation shown in FIG. 2, and the locking mechanism is placed in the position shown in FIG. 2, and the handle bar means is then rotated counterclockwise, the bar 118 will move into registration with ramped portion 202 (see also FIG. 4) to cause pawl 136 to rotate slightly counterclockwise. When bar 118 comes into registration with indentation 142, the user may detect a slight clicking or vibration, thus alerting him that the handle bar means 20 is in its preselected or fixed position.

If handle bar means 20 is initially clockwise of its position shown in FIG. 2, and the looking mechanism is placed in its first or locked position shown in FIG. 2, the user may rotate handle bar means 20 clockwise, causing bar 118 to come into contact with surface 204 of pawl 136 until bar 118 comes into registration with indentation 142. Upon registration between bar 118 and indentation 142, the user may detect the vibration or clicking, as described, and that the handle bar means is in its preselected or fixed position. The registration between spring member 192 and cam member 194 is such that after the handle bar means 20 is brought into its preselected or fixed position, no further adjustment of knob 170 or rod 160 is required.

If the user desires to place the locking mechanism 22 in its second, or unlocked, position, he moves the knob 170 away from himself to place rod 160 proximate the top end 168 of hole 164, thus moving indentation 142 out of registration with bar 118. The handle bar means is thus freed to pivot about axle 150. As the user operates 72 and 74 with his feet while seated upon seat 52, he may also move handle bar means, via handles 122 and 124, toward and away from himself, thus providing exercise not only to his lower extremities, but also to his upper torso, including his abdomen, back, arms, and shoulders, etc., and also increasing the amount of aerobic exercise engaged in.

Fluid cylinder 146 may also be provided with a convenient adjustment means, various forms of which are commonly known in the art, to regulate or vary the amount of resistance offered to the pivoting motion of the handle bar means 20.

Reference herein to details of the illustrated embodiment is not intended to limit the scope of the appended claims, which themselves recite those features regarded as essential to the invention.

What is claimed is:

1. An exercise cycle comprising:

frame means for positioning on a support surface;

seat means adapted to said frame means to support a user thereon;

drive means adapted to said frame means for operation by the feet of a user positioned upon said seat means;

first resistance means adapted to said frame means and drivingly interconnected to said drive means to resist movement of said drive means;

handle bar means adapted to said frame means for grasping by the user positioned on said seat means and for movement toward and away from the user positioned upon said seat means;

second resistance means interconnected to and between said handle bar means and said frame means to resist movement of said handle bar means; and locking means adapted to said frame means for selectively preventing movement of said handle bar means and operable by the user between a first position in which said handle bar means is movable toward and away from the user and a second position in which said handle bar means is locked in a preselected position and not movable, said locking means including:

a shaft transversely and rotatably mounted to said frame means, a bar adapted to said handle bar means, catch means adapted to said shaft operable between said first position in which said bar is engaged and said handle bar means is locked and not movable and said second position in which said bar is movable relative to said catch means, and lever means positioned for movement by said user and adapted to said shaft for movement between said first and second positions.

2. The exercise cycle of claim 1 wherein said frame means includes:

leg structure shaped and formed for positioning on the support surface and to support the exercise cycle with the user thereon, said leg structure having a forward leg portion and a rear leg portion; and a housing member affixed to said leg structure having a face portion reachable by the arms of a user positioned on said seat means, said lever means extending through said face portion.

3. The exercise cycle of claim 2 wherein:

said first resistance means is a wheel with a brake adjustably associated therewith operable by the user to vary the resistance;

said second resistance means is a fluid cylinder; and said seat means includes a support member connected to said frame mean with a seat attached at the distal end of said support member.

4. The exercise cycle of claim 3 wherein said handle bar means includes tubular structure having an upper end and a lower end, handle means secured to said upper end for grasping by the user, and pivot means secured to said tubular structure at a preselected distance from said lower end for pivotally mounting said tubular structure within said housing member; and wherein said bar is adapted to said tubular structure proximate said lower end, and said fluid cylinder is connected to said tubular structure proximate said lower end.

5. The exercise cycle of claim 4 wherein said drive means includes:

a pedal assembly positioned for movement by the feet of said user; and a chain and sprocket drive assembly interconnected between said pedal assembly and said wheel for rotation of said wheel upon operation of said pedal assembly.

6. The exercise cycle of claim 5 wherein said tubular structure is a pair of spaced apart tubes, said pivot means is secured between said spaced apart tubes, and said bar is secured between said spaced apart tubes.

7. The exercise cycle of claim 6 wherein said catch means includes a pawl within a distal end having an indentation formed proximate said distal end to register with said bar, and wherein said pawl is secured to said lever means to rotate said indentation into and out of registration with said bar as said lever is moved between said first and said second positions.

* * * * *

UNITED STATES PATENT AND TRADEMARK OFFICE

CERTIFICATE OF CORRECTION

PATENT NO. : 4,844,451

DATED : July 4, 1989

INVENTOR(S) : George Bersonnet and Dante Schumway

It is certified that error appears in the above-identified patent and that said Letters Patent is hereby corrected as shown below:

Column 5, line 16, change "first" to --second--.

Column 5, line 26, change "second" to --first--.

Column 8, line 5, change "first" to --second--.

Column 8, line 7, change "second" to --first--.

Signed and Sealed this

Fifth Day of May, 1992

*Attest:*

DOUGLAS B. COMER

*Attesting Officer*

*Acting Commissioner of Patents and Trademarks*